United States Patent [19]

Wessa

[11] Patent Number: 4,966,015

[45] Date of Patent: Oct. 30, 1990

[54] APPARATUS FOR THE PRODUCTION OF SMALL CLEAR ICE BODIES

[76] Inventor: Theo Wessa, Siedlung 19, 6751 Mackenbach/Pfalz, Fed. Rep. of Germany

[21] Appl. No.: 465,953

[22] Filed: Jan. 16, 1990

Related U.S. Application Data

[63] Continuation-in-part of Ser. No. 324,400, Mar. 16, 1989, abandoned.

[30] Foreign Application Priority Data

Mar. 19, 1988 [EP] European Pat. Off. ..... 88104430

[51] Int. Cl.[5] ..... F25C 1/04

[52] U.S. Cl. ..... 62/347; 62/352; 137/251.1; 137/334; 239/220

[58] Field of Search ..... 62/347, 348, 352; 137/74, 251.1, 254, 334; 239/219, 220

[56] References Cited

U.S. PATENT DOCUMENTS

| | | | |
|---|---|---|---|
| 2,722,110 | 1/1955 | Denzer | 62/347 X |
| 2,729,070 | 1/1956 | Ames | 239/220 X |
| 2,995,850 | 8/1961 | Strauss | 239/220 X |
| 3,062,018 | 1/1962 | Baker | 62/352 X |
| 3,386,258 | 6/1968 | Zygul | 62/347 X |
| 4,006,605 | 2/1977 | Dickson et al. | 62/347 X |
| 4,505,130 | 3/1985 | Hibeno et al. | 62/348 X |
| 4,602,489 | 7/1986 | Hara | 62/347 X |
| 4,612,959 | 9/1986 | Costello | 137/251.1 X |

*Primary Examiner*—William E. Tapolcai

*Attorney, Agent, or Firm*—Toren, McGeady & Associates

[57] ABSTRACT

An apparatus for producing small clear ice bodies includes an evaporator (110) having freezer cells (12) open at the bottom and cooled by a refrigerant pipe (11). Interspaces between the freezer cells (12) are covered by strips (114) of insulating material. On the outside of the insulating material (114) defrosting components are arranged, formed of metal strips (17). Water is sprayed upwardly out of a trough (30) into the freezer cells by means of a spraying device (20) in the form of a bucket wheel rotatable about a horizontal shaft (29). The bucket wheel has two spaced parallel circular discs (28) with concave splash blades (27) arranged between them. The water sprayed upwardly keeps the metal strips (17) at above-freezing temperatures, so that ice layers cannot form and interconnect the small ice bodies. Splash-guard walls (33), as well as a movable splash-guard flap (32), prevent the escape of water from the apparatus. When defrosted, small ice bodies (1) fall onto an inclined grid (36). At the beginning of a freezing cycle, the trough (30) is filled via a supply pipe (35) having a valve (39) and, at the end of a freezing cycle, is emptied via a discharge pipe (34) having a valve (38).

9 Claims, 4 Drawing Sheets

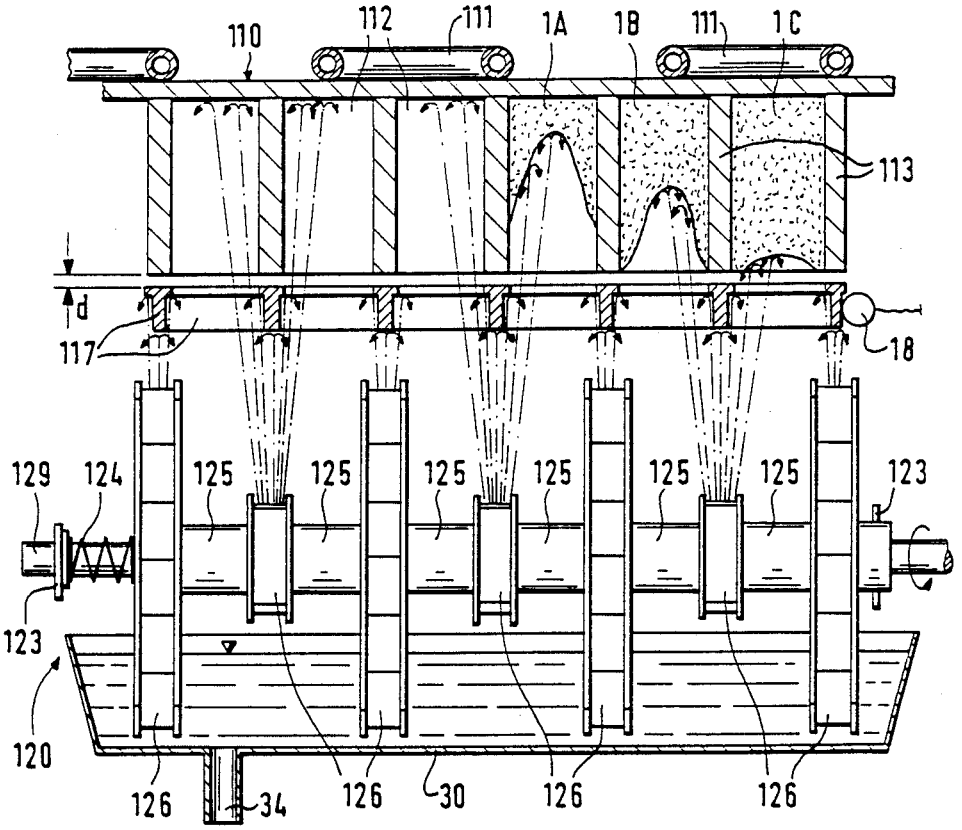
FIG. 4
FIG. 5
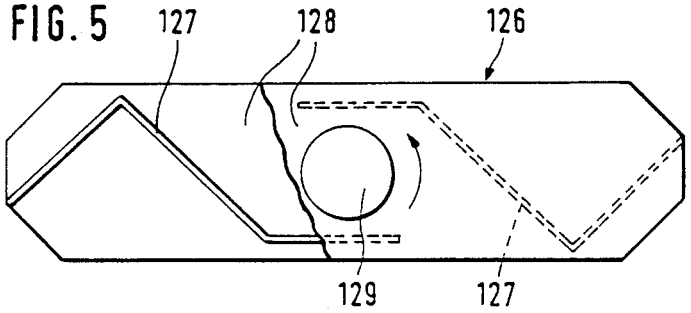

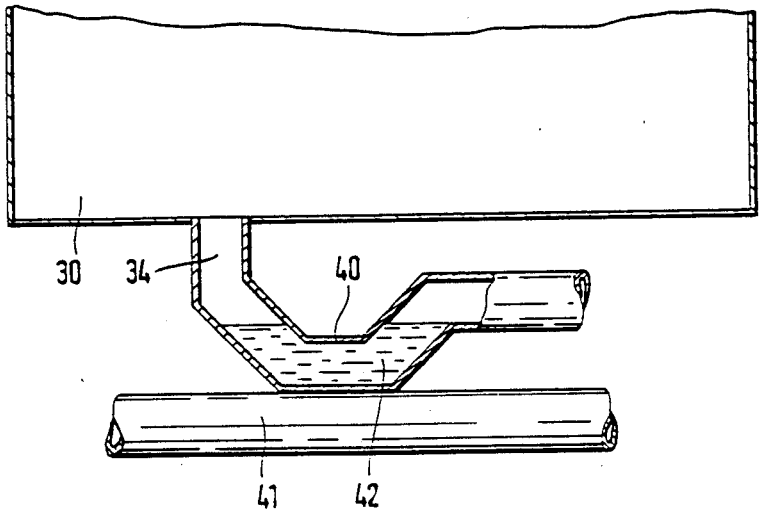
FIG. 6
FIG. 7
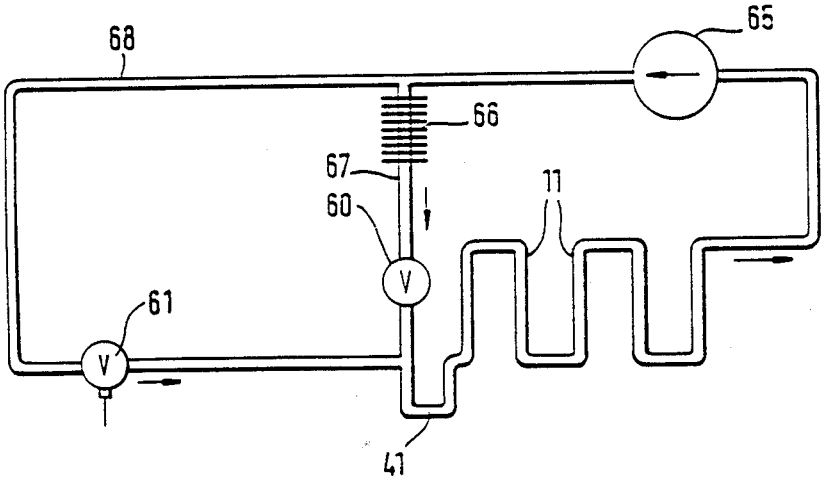

APPARATUS FOR THE PRODUCTION OF SMALL CLEAR ICE BODIES

This is a Continuation-In Part of Patent Application Ser. No. 07/324,400 filed Mar. 16, 1989 now abandoned by Theo Wessa for APPARATUS FOR THE PRODUCTION OF SMALL CLEAR ICE BODIES

BACKGROUND OF THE INVENTION

The present invention relates to apparatus for the production of small clear ice bodies and comprises an evaporator connected to a refrigeration cycle with freezer cells open at the bottom or lower side, a water trough arranged below the evaporator and a mechanical spraying device for spraying water from the trough into the freezer cells.

U.S. Pat. No. 4,602,489 discloses a device containing a maximum number of freezer cells per evaporator area, since they are located side by side without interspaces between them. Due to the close arrangement of the freezer cells, a layer of ice forms not only in the freezer cells, but also on the bottom of the cells, whereby at the end of the cycle, all of the small ice bodies freeze together and form a single layer. Accordingly, a heatable grid or screen is located beneath the freezer cells and spaced from them. The grid cuts up the ice layer when the small ice bodies are collected. This technology has been disclosed previously in U.S. Pat. No. 2,747,375.

The water required to form the small clear ice bodies is sprayed into the center of each freezer cell by a respective water nozzle. The nozzles are secured in water tubes located below the freezer cells. The sprayed water does not freeze immediately, however, it has lost heat and runs down the cell walls onto the metal grid and freezes to the metal grid along with the small ice bodies which form in the downward direction. Any water not frozen to the grid returns to the pumping cycle.

As the small ice bodies grow in size, a continuous layer of ice develops. After a given time, the plastic insulation plate also reaches freezing temperature. As a result, a continuous layer or plate of ice is formed with the small ice bodies frozen to it.

During the defrosting operation, the freezer cells and the metal screen are heated. Thus, initially, the ice plate is detached from the metal screen and the small ice bodies are loosened from the metallic cell walls. Because of the poor thermal conductivity of the plastic plate, the small ice bodies cling to it for a longer time. Only after the plastic plate has heated up, is it possible for the small ice bodies to slide downwardly. During this time period, the small ice bodies in the freezer cells become progressively warmer and are considerably melted down, thus, an ice plate, with partially melted ice bodies frozen to it, falls onto the water tubes and only after the ice plate has melted, can the individual ice bodies fall onto an inclined diverting surface and pass into a storage container. In this procedure, the screen is cooled so that ice forms on it. Moreover, the nozzles tend, as is known, to become blocked by impurities and minerals contained in the water.

One disadvantage of this apparatus is the extended time required for the ice layer to melt, whereby a considerable amount of melt-water is produced, and a considerable amount of energy is required, first, to produce the ice layer, and then to melt through the layer.

It is also disadvantageous that the small ice bodies frozen to the plate must melt while supported on the water tubes before the individual small ice bodies can drop into the storage container. No ice production is possible during this time.

U.S. Pat. Nos. 3,043,117, 2,729,070, 2,722,110, 3,254,501, 3,386,258, 2,978,882 and 3,040,545; Great Britain Pat. No. 2,013,857, and French Pat. No. 1,571,033 disclose apparatus for the production of the small clear ice bodies where the freezer cells are spaced with respect to one another and the space therebetween is covered or filled with thermal insulating material. This insulating material should prevent formation of an ice layer which freezes all of the small ice bodies to one another.

The device in Great Britain patent application 2,013,857 and U.S. Pat. Nos. 3,254,501, 4,505,130 and 4,006,605 and French Pat. No. 1,571,033 demonstrate that the same could not be achieved in the manner described. In these known devices, the insulating material between the freezer cells is heated during defrosting of the small ice bodies and, indeed, in Great Britain patent application, 2,013,857 and U.S. Pat. Nos. 4,505,130 and 4,006,605, is heated by warm water, while in French Pat. No. 1,571,003, the heat is provided by a hot gas, and in U.S. Pat. No. 3,254,501, the heat is supplied by electric current. Experience has shown that none of these devices wa successful; neither is the formation of ice prevented, nor is the ice defrosted at the proper time.

As already indicated, the nozzles which spray the water into the freezer cells, tend to become clogged. Therefore, attempts have been made to spray the water into the freezer cells using simple mechanical devices. In this regard, U.S. Pat. No. 3,386,258 proposes a multiple-blade propeller which revolves about a vertical axis with the blades dipping slightly into the trough water and producing a water mist. The efficiency of this device is very low. In addition, the water level in the trough must be controlled accurately.

U.S. Pat. No. 2,729,070 proposes the use of discs rotating around a horizontal shaft and plunging into the water trough. Such discs convey only a small amount of water which clings to them by adhesion. Moreover, the spraying direction cannot be controlled, whereby only a small amount of water reaches the freezer cells.

To improve the conveying efficiency, U.S. Pat. No. 2,722,100 proposes arranging vanes on the sides of the rotating discs. In such an arrangement, however, the water clings to the vanes also due to adhesion, so that again very little water is conveyed and is sprayed mainly in the wrong direction. Furthermore, control of the water level in the trough in also required in this arrangement.

During a freezing cycle pollutants and minerals become centratrated in the residual water in the trough. For this reason, the trough is emptied prior to being refilled with fresh water. In order to empty the trough, either it is tilted, or an electromagnetic valve in the discharge pipe is opened. In the latter instance, there is the danger that the function of the valve is obstructed by particles of dirt or minerals.

If it is attempted to increase the ice-producing capacity of known apparatus, for instance, to 1,000 kg or more of the small ice bodies per day, by appropriately increasing the dimensions of the evaporator, trough, spraying device, and the like, then they become bulky and uneconomical. The actuators for swivelling the trough and for pumping the water become large and heavy, the dead volumes increase the size of the housings, the electrical terminal load reaches values which can no longer be provided, and other problems develop. For these reasons, the known apparatuses and also those constructed according to U.S. Pat. No 3,654,771 are available commercially with only relatively small capacities of, for example, a maximum of 250 kg per day.

SUMMARY OF THE INVENTION

The present invention is based on the object of providing an apparatus of the kind mentioned above for the production of small clear ice bodies which, with minimal mechanical and energy outlay, permits the production of small clear ice bodies, without the formation of a layer of ice on the bottoms of the ice bodies which would form an integral ice unit. Moreover, another object of the invention is to provide a simple, economical and operationally reliable mechanical device permitting large quantities of water to be sprayed from the trough and aimed into the evaporator.

These objects are met by using defrosting elements formed of mechanical strips in thermal contact with one another and located on the external lower side of the evaporator facing the trough and positioned closely spaced from the free or lower ends of the freezer cells. Further, the spraying device is made up of at least one bucket wheel rotating around a horizontal shaft and formed of two parallel discs with at least one concavely shaped bucket blade or vane located between the discs.

Therefore, the present invention does not attempt to subsequently divide the ice layer which freezes the lower ends of the small ice bodies together by means of a heatable screen or to prevent the formation of such an ice layer between the freezer cells by means of thermally insulating material or large mutual spaces. Instead, the present invention proposes to maintain the screen of metal strips at such a high temperature, with the assistance of large quantities of sprayed water, that no ice layer can form. The metal strips are adequately heated by the water sprayed upwardly, which water is always at a positive temperature.

It should be understood that care must be taken that the sprayed water can supply an adequate amount of heat to the metal strips. For this purpose, the metal strips are designed preferably as water-heat exchangers, for instance, with profiled surfaces.

If the freezer cells are spaced from one another, such as for producing small ice bodies of an octagonal or circular cross-section, the intermediate spaces between them must be covered with insulating material to prevent the water sprayed into the freezer cells from also reaching the rear or upper side of the evaporator. In addition, the insulating material can also serve to mechanically hold the defrosting elements.

Bucket wheels, as used in the present invention, are extremely sturdy, have a particularly long useful life, and can be fabricated very economically. The required power for driving the bucket wheel is very low. The bucket formed by the wheel, having a concavely curved shape, conveys large quantities of water. The spraying direction can be oriented toward the freezer cells due to the combined effect of the two discs and the concavely curved blades or vanes forming the bucket. It is not necessary to control the level of the water in the trough. The small ice bodies are made perfectly clear, even at high freezing output of the evaporator, while all of the presently known machines produce only cloudy small ice bodies. The spraying arrangement of the present invention increases the production capacity of the inventive apparatus.

Finally, another object of the present invention is to provide an apparatus permitting opening or closing of the water drain for the trough without requiring the movement of any mechanical parts.

In accordance with the present invention, the drain for the residual water is equipped with a siphon in thermal contact with a refrigerating line. Accordingly, water present in the siphon is frozen into an ice plug at the start of the freezing cycle, whereby the drain is closed. At the end of the cycle, hot-gas replaces the refrigerant in the line, the ice plug melts, and the trough is drained. There is the advantage that blockages by minerals or dirt is prevented due to the large tube diameter. Moreover, the usual tipping of the trough is eliminated, so that, in the event of a power failure, the trough is drained automatically, which is not the case in the known devices. This drain arrangement considerably promotes the hygiene of the apparatus.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

FIG. 4 is a schematic side view, partly in section of a second embodiment of the present invention for forming small clear ice bodies;

FIG. 5 is a side view, partly broken away, of a bucket wheel, as illustrated in FIG. 4;

FIG. 6 is a side view, partly in section, of a seal for a water trough; and

FIG. 7 is a basic diagram of the piping in accordance with the present invention for the refrigerant and hot-gas systems.

DETAILED DESCRIPTION OF THE INVENTION

Figure 1:
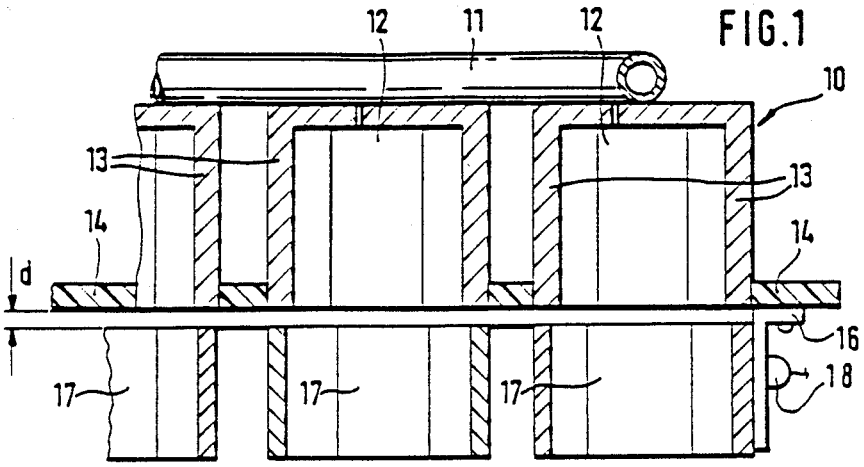
FIG. 1 is a partially vertically extending cross-section of an evaporator embodying the present invention.
Figure 2:
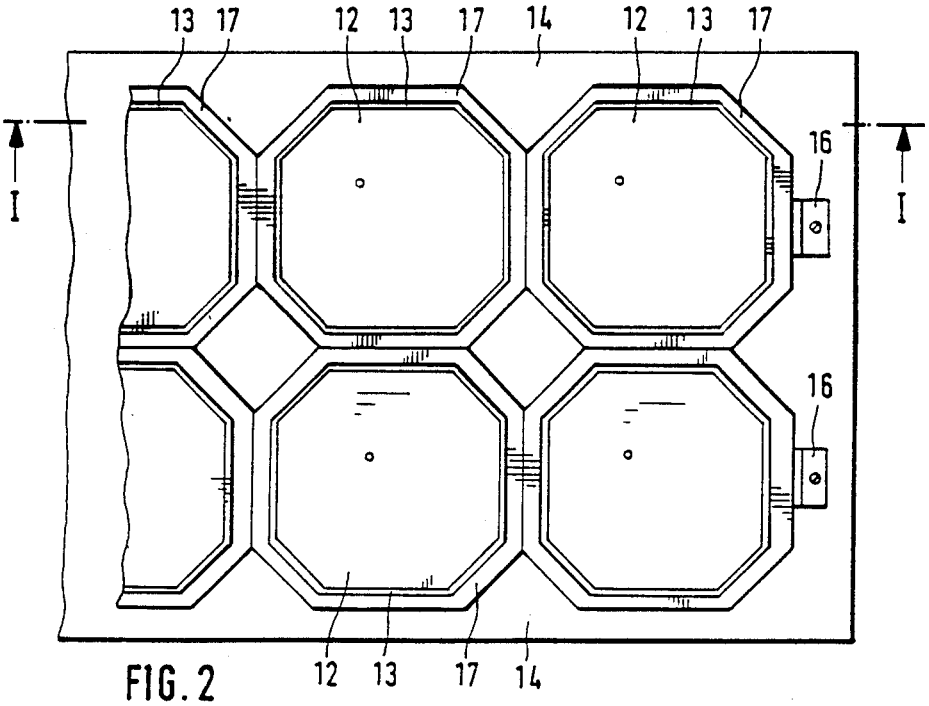
FIG. 2 is a bottom plan view of the evaporator displayed in FIG. 1.

FIGS. 1 and 2, respectively, show an evaporator 10, in cross-section, and in a bottom view, for the production of small clear ice bodies 1. Pipes 11, through which refrigerant passes during the freezing process, and hot gas during the defrosting operation, are in contact with freezer cells 12, which are open at the bottom and closed at the top. Gaps or spaces between the individual freezer cells 12, or their side walls 13 are covered by an insulating plate 14, so that water sprayed upwardly cannot reach the upper or rear sides of the freezer cells 12.

Metal strips 17, forming defrosting elements, are located below the insulating plate 14 facing the water trough. Metal strips 17 are shaped to correspond to the transverse configuration of the freezer cells 12. The strips are spaced a small distance d below the open and lower or free ends of the freezer cells 12.

As viewed in FIG. 2, the freezer cells are octagonal for producing octagonally-shaped small ice bodies. It is self-evident that small ice bodies with round, oval, hexagonal, square and other cross-sections can be formed, as desired. Further, these small ice bodies can be hemispherically, pyramidally, conically and annularly shaped.

If water is sprayed upwardly from below into the freezer cells 12, it freezes into small clear ice bodies. At the same time, the spray water heats the metal strips 17 so that the formation of an undesirable ice layer between the freezer cells is prevented. A thermal sensor 18, fastened to the metal strips 17, indicates when the small ice bodies have attained their final size. During the collection of the ice bodies 1, hot gas is conducted through the pipes 11 on the rear side of the freezer cells 12. As a result, the small ice bodies fall individually out of the freezer cells 12.

Metal strips 17 are specially designed water-heat exchangers so that they always remain adequately warm. If a layer of ice forms on them, however, it is sufficient to fill the trough with fresh water and to operate the mechanical spraying device so that the ice layer melts immediately.

Figure 3:
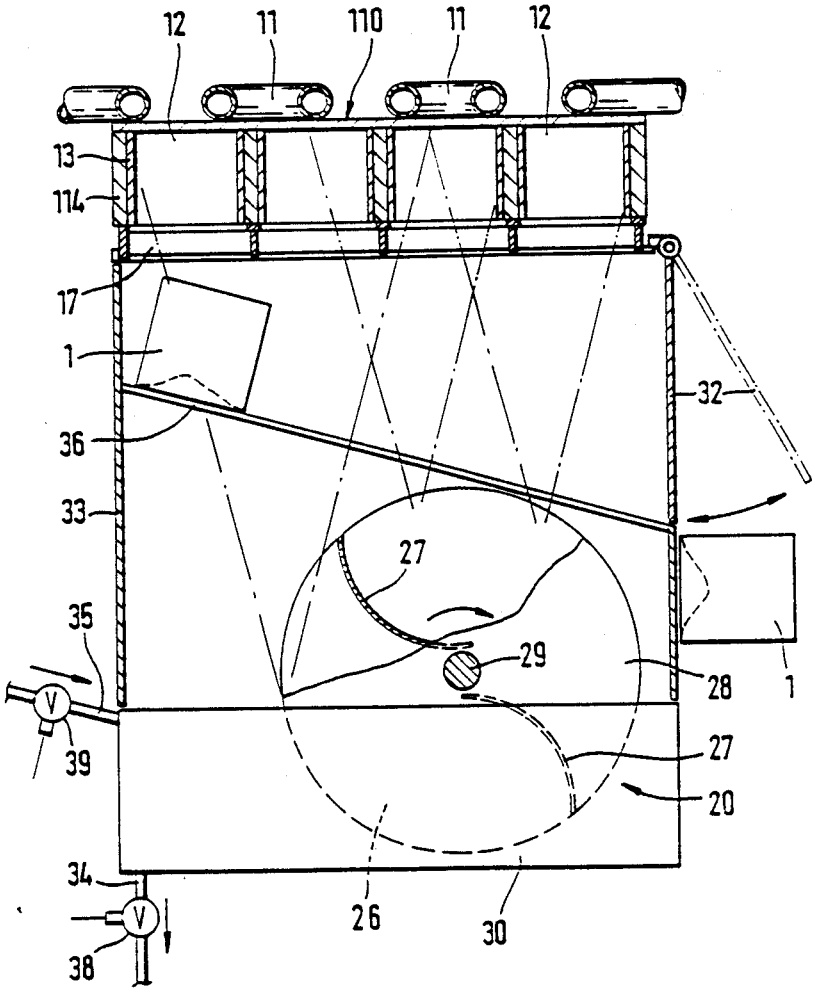
FIG. 3 is a schematic side view, partly in section, of a first embodiment of the present invention used for forming small clear ice bodies.

FIG. 3 is a view of a first example of an ice machine embodying the present invention and having a stationery spraying device in the form of a rotating scoop-up or bucket wheel 26 which plunges into a water trough 30. The evaporator comprises four rows of freezer cells 12 which are fastened to the lower side of a common base plate.

Insulating material strips 114 are positioned between the freezer cells 12. The metal strips 17 are spaced outwardly from the free edges of the freezer cells so that the cold water dripping from the side walls 13 of the freezer cells does not contact the metal strip 17 or contacts them only slightly. Additionally, the strips 114 prevent the water sprayed upwardly from reaching the spaces between the freezer cells 12. The bucket wheel 26 is formed of two spaced parallel circular discs 28 with two concave centrifugal blades or vanes 27 extending between then. The bucket wheel rotates about a horizontal shaft 29. Due to the combined effect of the two circular discs 28 and the concave vanes 27, large quantities of water can be sprayed in a directed manner toward the metal strips 17 and into the freezer cells 12.

Above the spraying device 20, a longitudinally slotted covering plate or grid 36 is positioned. The grid 36 permits water to be sprayed upwardly without any interference, however, it prevents small ice bodies 1 from falling downwardly onto the bucket wheel 26 or into the trough 30 during the defrosting operation. Instead, the small ice bodies slide down the grid 36 into a storage container, not shown, below the trough 30.

Splash-guard walls 33 serve to return non-frozen water to the trough 30.

A movable flap 32 which guides excess water back into the trough 30 also serves as a splash guard without restricting the passage of the small ice bodies 1 into the storage container A supply line or pipe 35 containing an electromagnetically-actuated valve 39 is provided for filling the trough 30 with fresh water. A discharge pipe 34 with an electromagnetically-operated valve is provided for the emptying of the trough 30.

FIG. 4 contains an elevational view, partly in section, of another apparatus for forming small clear ice bodies and including a stationery spraying device 120 with rotating bucket wheels 126. Evaporator 110 has freezer cells 12 open downwardly toward the spraying device 120 with the cells defined by simple separating walls 113. In transverse cross section, the freezer cells are rectangular or square in shape. Since there are no spaces or gaps between the freezer cells 112, the ice making capacity is at a maximum.

Metal strips 117, forming defrosting elements, are located a small distance d below the freezer cells 112. In cross section, as viewed in FIG. 4, the metal strips 117 are T-shaped to assure an optimum transmission of heat from the water sprayed upwardly toward the metal strips.

A thermosensor 18 measures the temperature of the metal strips on 17.

Spraying device 120 is formed by a row of rotating bucket wheels 126 mounted on a horizontal rotating shaft 129. The spacing of the bucket wheels 126 is assured by spacers 125. A spring 124 encircling the shaft 129 provides the requisite contact pressure for the assembly of the wheels 126 and the spacers 125 on the shaft 129.

The bucket wheels 126 are optimally positioned below the metal strips 117. According, a maximum quantity of the water sprayed upwardly can warm the metal strips 117. The small ice bodies 1 grow in the freezer cells 112 during the freezing or refrigeration cycle, as depicted by the cells with the reference characters 1A, 1B and 1C. As soon as the small ice bodies 1 reach their final size, the ice reaches the metal strips 117 and the temperature of the strips falls below the freezing point.

This temperature drop in the metal strips is sensed by the thermosensor 18. As a result, the operation of the apparatus is switched from the freezing cycle to the defrosting or collecting cycle. The small ice bodies 1 are defrosted by hot gas which passes through the pipes 111. The inclined cover 36 located below the evaporator 110 is not shown in FIG. 4 to assist in the clarity of the drawing.

If ice forms on the metal strips 117, the water trough 30 is filled with water to accelerate the defrosting process and the spraying device 120 is placed in operation. Water, sprayed upwardly by the bucket wheels, heats the metal strips and any ice formed thereon is melted and falls off. The small ice bodies 1 in the freezer cells fall individually onto the inclined grid and then into the storage container, not shown.

In FIG. 5, an improved bucket wheel is displayed. The bucket wheel 126 is made up of two spaced parallel metal plates 128, however, the plates have a generally rectangular shape and are not circular discs. Because of the shape of the plates 128, they are immersed in the water for only a short period which diminishes friction. The blades or splash vanes 127 are bent into a V-shape affording a concave bucket-like form. The quantity of water sprayed or splashed upwardly, as well as the spraying direction, can be influenced by the angle between the legs of the V-shaped vanes and by the alignment or orientation of the legs.

FIG. 6 illustrates another and particularly simple and reliable closure or seal for the drain pipe 34 of the trough 30. The drain pipe 34 has a siphon portion 40 in thermal contact with a refrigerant pipe 41. The water remaining in the siphon portion 40 is frozen into an ice plug or stopper 42 at the commencement of the freezing cycle and is maintained at a negative or below-freezing temperature. At the end of the freezing cycle, hot gases are passed through the pipe 41, the ice plug 42 is melted, and the trough is emptied. Since the cross-section of the siphon portion 40 is considerably larger than the cross section of, for instance, the electromagnetically actuated drain valve 38, and since the siphon portion 40 does not contain any moving parts, it is more reliable in operation than the known valves.

FIG. 7 contains a basic circuit arrangement of the pipeline of the refrigerant and the hot-gas cycles. Refrigerant is compressed in compressor 65, is liquified in condenser 66, and supplied to an expansion valve 60 through pipeline 67, and downstream of this pipeline it is cooled to a temperature of approximately −15° C. The refrigerant then flows through the line 41 and, subsequently, through the refrigerant pipes 11 so as to be again aspirated and compressed by the compressor 65. A hot-gas valve 61 in by-pass line 68 is closed during the freezing process.

As soon as the small ice bodies have attained their final size, the hot-gas valve 61 is opened. Hot-gas flowing from the compressor 65 passes through by-pass line 68, through the hot-gas valve 61 and into the line 41 for melting the ice plug 42 in the trough drain line 34, whereby the trough 30 can drain itself, and then the hot-gas flows through the refrigerant pipes 11 on the rear or upper side of the freezer cells 12 so that the small ice bodies can drop out.

The advantage of these embodiments is that the defrosting elements are continuously heated by the water sprayed upwardly, and a freezing together of the small ice bodies is prevented with certainty. The rotating bucket wheels 26, 126 are extremely sturdy, have a long useful lifetime, and have simple structures. The quantity of water and the width and direction of the spray flow from the bucket wheel can be adjusted by the shape of the blades or vanes 27, 127. The entire arrangement is compact and the freezing output can be adjusted to be particularly high. As mentioned above, in all circumstances, perfectly clear small ice bodies are formed.

While specific embodiments of the invention have been shown and described in detail to illustrate the application of the inventive principles, it will be understood that the invention may be embodied otherwise without departing from such principles.

I claim:

1. Apparatus for producing small clear ice bodies (1), comprising an evaporator (10, 110) connected to a refrigeration cycle and having freezer cells (12) with an upper end and a lower end with said cells closed laterally and at the upper end and open at the lower end, a water trough (30) faced downwardly from said evaporator (10, 110) an inclined cover (36) positioned between said water trough (30) and said evaporator (10, 110) for guiding small ice bodies (1) from said freezer cells into a storage container, and a mechanical spraying device (20) arranged to spray water from the trough (30) into the freezer cells (12), defrosting elements (17) are located below the lower ends of said freezer cells, said trough (30) is filled via a supply pipe (35) at the start of the freezing cycle and is drained at the end of the freezing cycle through a drain (34), wherein the improvement comprises that said defrosting elements (17) are formed of metal strips (17) in thermal contact with one another and located adjacent the lower ends of said freezer cells and extending toward said trough and said metal strips each have an upper edge and a lower edge with the upper edge spaced closely from the lower ends of said freezer cells, said spraying device comprises at least one bucket wheel (21, 126) rotating around a horizontal shaft (29), and including two spaced parallel plates with at least one vane extending therebetween with said vane bent in a concave manner and facing toward said freezer cells in the direction of rotation of said shaft for spraying water from said trough into said freezer cells.

2. Apparatus, as set forth in claim 1, wherein said cover (36) is a longitudinally slotted plate or grid-like screen.

3. Apparatus, as set forth in claim 1, wherein said metal strips are formed as water-heat exchangers (17).

4. Apparatus, as set forth in claim 1, wherein said vane (27) is bent in an approximate V-shape.

5. Apparatus, as set forth in claim 1, wherein said parallel plates (128) of said bucket wheel (126) are rectangularly shaped.

6. Apparatus, as set forth in claim 1, wherein a thermosensor is fastened to said metal strips (17).

7. Apparatus, as set forth in claim 1, wherein said freezer cells (12) are spaced apart at least around a portion of the circumference thereof and said spaces are covered with insulating material in the form of plates or strips (14).

8. Apparatus, as set forth in claim 1, wherein said plates are in the shape of circular discs with a pair of said vanes located on diametrically opposite sides of said shaft extending between said discs.

9. Apparatus for producing small clear ice bodies (1) comprising an evaporator (10, 110) connected to a refrigeration cycle and having freezer cells (12), said freezer cells having an upper end and a lower end with said cells closed laterally and at the upper end and being open at the lower end, a water trough spaced downwardly from said evaporator, and a mechanical, spraying device arranged to spray water from the trough (30) into said freezer cells (12), defrosting elements are located between said freezer cells and said spraying device, said trough (30) is filled via a supply pipe (35) at the start of the freezing cycle and is drained through a drain (34) at the end of the freezing cycle, wherein the improvement comprises that said drain (34) comprises a siphon portion (40) in thermal contact with a refrigerant pipe (41) for selectively flowing one of a refrigerant and a hot-gas therethrough.

* * * * *